US006782952B2

(12) United States Patent
Garay et al.

(10) Patent No.: US 6,782,952 B2
(45) Date of Patent: Aug. 31, 2004

(54) HYDRAULIC STEPPING VALVE ACTUATED SLIDING SLEEVE

(75) Inventors: Thomas W. Garay, Humble, TX (US); Edward J. Zisk, Kingwood, TX (US); Brian A. Roth, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 62 days.

(21) Appl. No.: 10/269,662

(22) Filed: Oct. 11, 2002

(65) Prior Publication Data

US 2004/0069491 A1 Apr. 15, 2004

(51) Int. Cl.[7] ..... E21B 34/10
(52) U.S. Cl. ..... 166/374; 166/320; 251/325
(58) Field of Search ..... 166/320, 250.01, 166/374, 375, 386, 321, 324, 237; 251/325, 205; 92/110

(56) References Cited

U.S. PATENT DOCUMENTS 5,211,241 A 5/1993 Mashaw, Jr. et al. ..... 166/332
5,316,084 A * 5/1994 Murray et al. ..... 166/332.4
6,422,317 B1 * 7/2002 Williamson, Jr. ..... 166/374
6,585,051 B2 * 7/2003 Purkis et al. ..... 166/374
6,668,936 B2 * 12/2003 Williamson et al. ..... 166/375
2002/0014338 A1 2/2002 Purkis et al. ..... 166/375
2003/0183392 A1 * 10/2003 Garay et al. ..... 166/320

FOREIGN PATENT DOCUMENTS

WO WO 02/20942 A1 3/2002 ..... E21B/34/10

* cited by examiner

*Primary Examiner*—David Bagnell
*Assistant Examiner*—Daniel P Stephenson
(74) *Attorney, Agent, or Firm*—Madan, Mossman & Sriram, P.C.

(57) ABSTRACT

A downhole well valve having a variable area orifice (26) is flow area adjusted by a sliding sleeve (20) that is axially shifted along a tubular housing (12) interior in a finite number of increments. A hydraulic actuator (60) displaces a predetermined volume of hydraulic fluid with each actuator stroke. An actuator displaced volume of fluid shifts the flow control sleeve by one increment of flow area differential. An indexing mechanism (40) associated with the sleeve provides a pressure value respective to each increment in the increment series.

18 Claims, 6 Drawing Sheets

HYDRAULIC STEPPING VALVE ACTUATED SLIDING SLEEVE

BACKGROUND OF THE INVENTION

1. Field of the Invention

The present invention relates to the field of downhole well tools. More specifically, the invention relates to a downhole tool that provides a selectively variable fluid flow area between the well annulus and the interior flow bore of a well tube.

2. Description of Related Art

The economic climate of the petroleum industry drives producers to continually improve the efficiency of their recovery systems. Production sources are increasingly more difficult find and exploit. Among the many newly developed production technologies is directed drilling. Deviated wells are drilled to follow the layering plane of a production formation thereby providing extended production face within the production zone. In other cases, a wellbore may pass through several hydrocarbon bearing zones.

One manner of increasing the production of such wells is to perforate the well production casing or tubing in a number of different locations, either in the same hydrocarbon bearing zone or in different hydrocarbon bearing ones, and thereby increase the flow of hydrocarbons into the sell. However, this manner of production enhancement also raises reservoir management concerns and the need to control the production flow rate at each of the production zones. For example, in a well producing from a number of separate zones, or lateral branches in a multilateral well, in which one zone has a higher pressure than another zone, the higher pressure zone may produce into the lower pressure zone rather than to the surface. Similarly, in a horizontal well that extends through a single zone, perforations near the "heel" of the well (nearer the surface) may begin to produce water before those perforations near the "toe" of the well. The production of water near the heel reduces the overall production from the well. Likewise, gas coning may reduce the overall production from the well.

A manner of alleviating such problems may be to insert a production tubing into the well, isolate each of the perforations or lateral branches with packers and control the flow of fluids into or through the tubing. However, typical flow control systems provide for either on or off flow control with no provision for throttling of the flow. To fully control the reservoir and flow as needed to alleviate the above-described problems, the flow must be throttled.

A number of devices have been developed or suggested to provide this throttling although each has certain drawbacks. Note that throttling may also be desired in wells having a single perforated production zone. Specifically, such prior art devices are typically either wireline retrievable valves, such as those that are set within the side pocket of a mandrel or tubing retrievable valves that are affixed to the tubing.

SUMMARY OF THE INVENTION

An object of the present invention is a downhole valve for well flow regulation that incorporates a sliding sleeve to alter the fluid flow area between the well annulus and well tube flow bore. The tubular valve housing is ported with fluid flow openings in cooperative alignment with fluid flow ports through the sliding sleeve. When the sleeve ports are aligned with the housing ports, fluid flow is accommodated between the well annulus and the tube flow bore. When the sleeve ports are axially offset from the housing ports, fluid flow between the well annulus and the tube flow bore is obstructed. Sleeve port alignment is in graduated increments between a fully open valve and a fully closed valve.

Each increment of sleeve displacement is driven by a predetermined volume of hydraulic fluid released from a novel stepping valve. In one directional sequence, a distinctive fluid pressure also is required to step the sleeve from the prior increment to the next. Accordingly, greater fluid pressure is required to increase the valve flow area from one area increment to the next. Moreover, the pressure required for each shift of the sleeve is distinctive to the flow area increment that the sleeve is advancing toward (or from).

At each incremental location of the sleeve, the sleeve position is secured by a respective detent channel that accommodates a resiliently expanding snap ring. Each ring detent is flanked by a channel wall set at a predetermined acute angle. Steepness of the channel wall dictates the pressure required to radially constrict the resiliently biased snap ring. Provision of a distinctive channel wall angle respective to each valve flow area setting of the sleeve translates to a distinctive hydraulic pressure from the stepping valve essential to shift the sleeve from a particular setting.

BRIEF DESCRIPTION OF DRAWINGS

For a thorough understanding of the present invention, reference is made to the following detailed description of the preferred embodiments, taken in conjunction with the accompanying drawings in which like reference characters designate like or similar elements throughout the several figures of the drawing. Briefly.

DESCRIPTION OF PREFERRED EMBODIMENTS

In the following description, numerous details are set forth to provide an understanding of the present invention. However, it will be understood by those skilled in the art that the present invention may be practiced without these details and numerous variations or modifications from the described embodiments may be possible.

As used herein, the terms "up" and "down", "upper" and "lower", "upwardly" and "downwardly" and other like terms indicating relative positions above or below a given point or element are used in this description to more clearly describe some embodiments of the invention. However, when applied to equipment and methods for use in wells that are deviated or horizontal, such terms may refer to a left to right or right to left relationship as appropriate.

Generally, preferred embodiments of the invention provide a variable flow area valve assembly that includes an axially sliding valve sleeve adapted to regulate the flow of fluid through one or more orifices in the valve housing. The sleeve is axially translated from one flow area position to the next by the pressure of a measured volume of hydraulic fluid bearing on a cross-sectional area of the sleeve. A valve actuator operably attached to the valve housing transmits, from a surface source, the measured volume of hydraulic fluid necessary to shift the valve sleeve position from one flow increment to the next in a sequence of several locations between a fully open position to a fully closed position. The change in fluid flow area as the sleeve is actuated through the incremental positions varies so that predetermined changes in flow condition can be provided. As used herein, flow condition may refer to pressure drop across the valve and/or flow rate through an orifice in the valve.

At each position increment of the sleeve translation range between fully open and fully closed, the sleeve is secured from uncontrolled displacement by a resilient snap ring set in a sleeve ring seat. At each designated flow area position, is a detent channel in the valve housing. The snap ring on the sleeve expands into a respective detent channel. Each detent channel is defined between parallel channel walls. At least one wall of each channel is formed at an acute angle to the housing axis with each angle being progressively steep. Consequently, a relationship may be established between the channel wall angle respective to a particular flow area setting and the hydraulic pressure from the valve actuator necessary to displace the sleeve from the particular flow area to another.

Figure 1A:
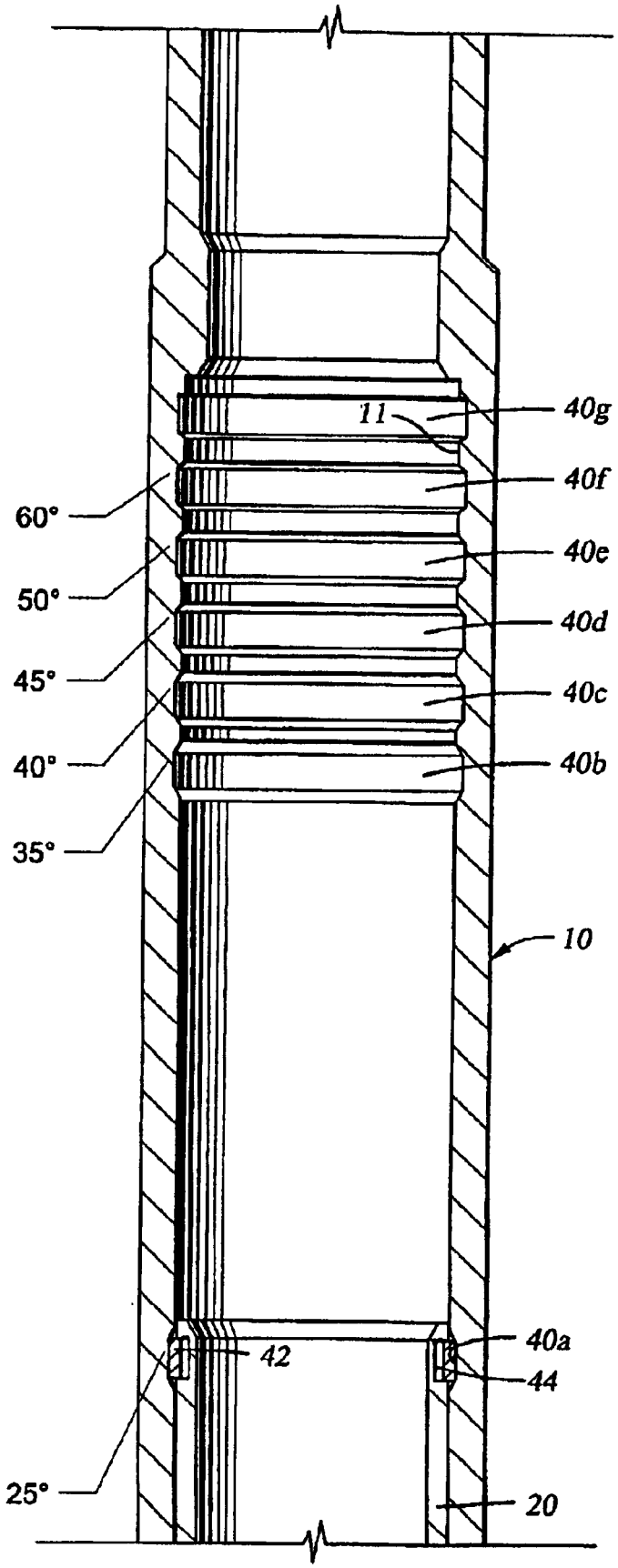
FIG. 1 is an axial length section of the invention presented in four longitudinal segments, 1A, 1B, 1C and 1D, respectively.

With respect to FIG. 1A, the "upper" end of the invention assembly includes an index housing 10 shown in cross-section to be a tubular element having a number of circumferential channels 40*a* through 40*g* turned about the internal bore perimeter 11. The side walls of these channels are set at distinctive acute angles. The side walls of the channel 40*a* may be cut at 25°, for example. Representatively, the side wall cut for channel 40*b* may be cut at 30°, the sidewall angle of channel 40*c* may be 35°, the sidewall angle for channel 40*d* may be 45°, the sidewall angle for channel 40*c* may be 50° and the sidewall angle of channel 40*f* may be 60°.

Figure 1B:
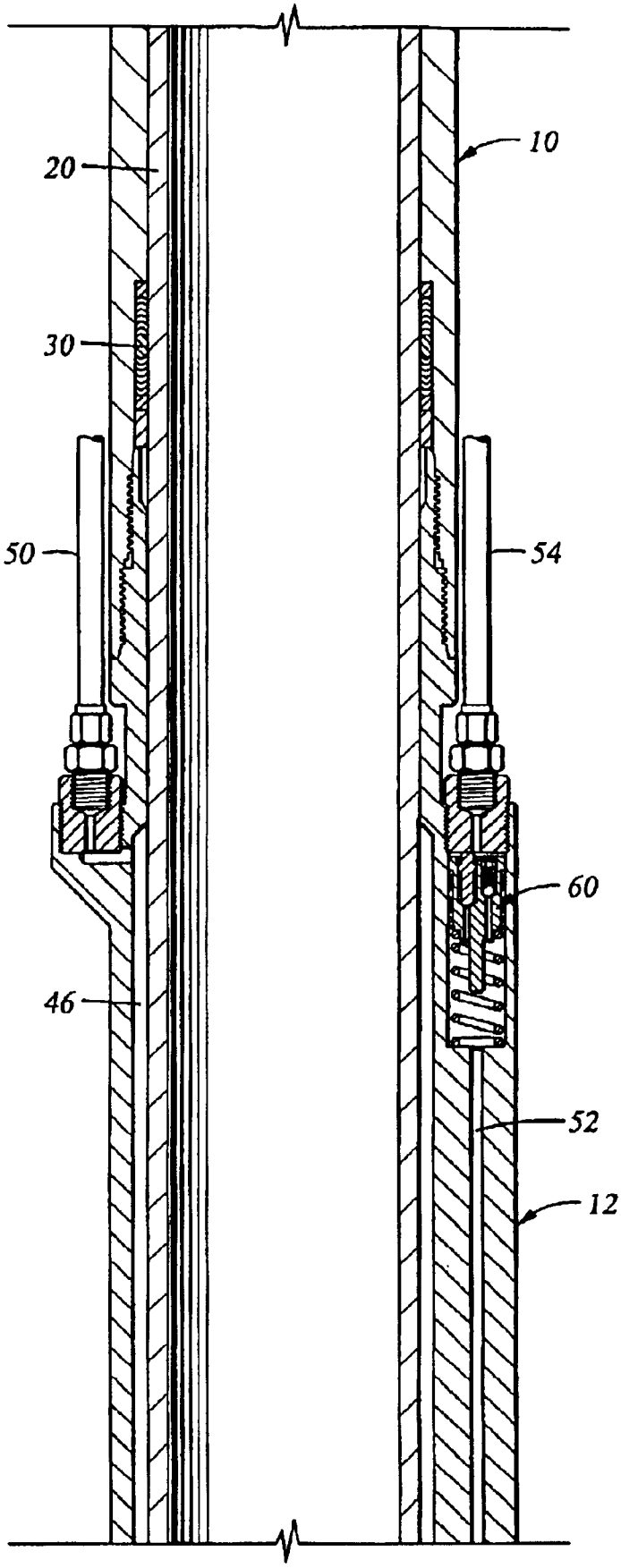

As shown by FIG. 1B, the lower end of the index housing 10 threadably assembles with a tubular actuator housing 12. The assembly joint between the index housing 10 and the actuator housing 12 compresses a chevron seal 30 that wipes the outer cylindrical surface of an axially shifted flow regulator sleeve 20.

Figure 1C:
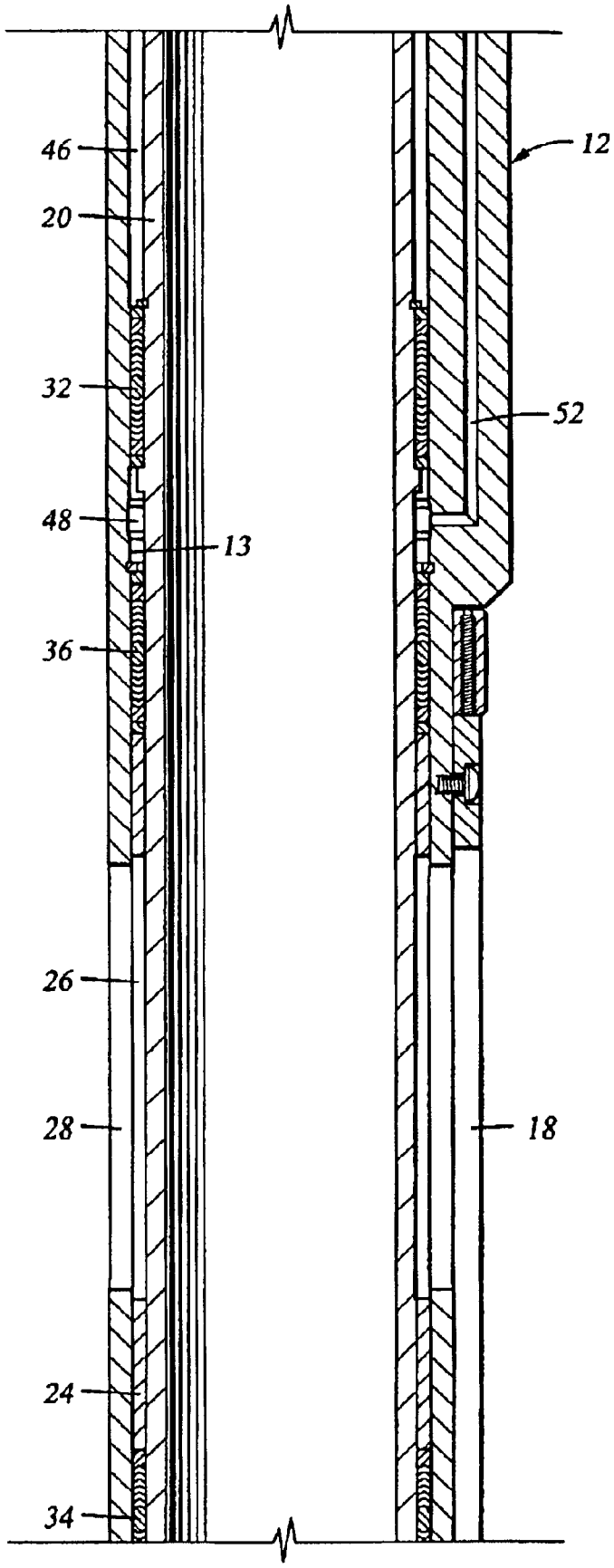
Figure 1D:
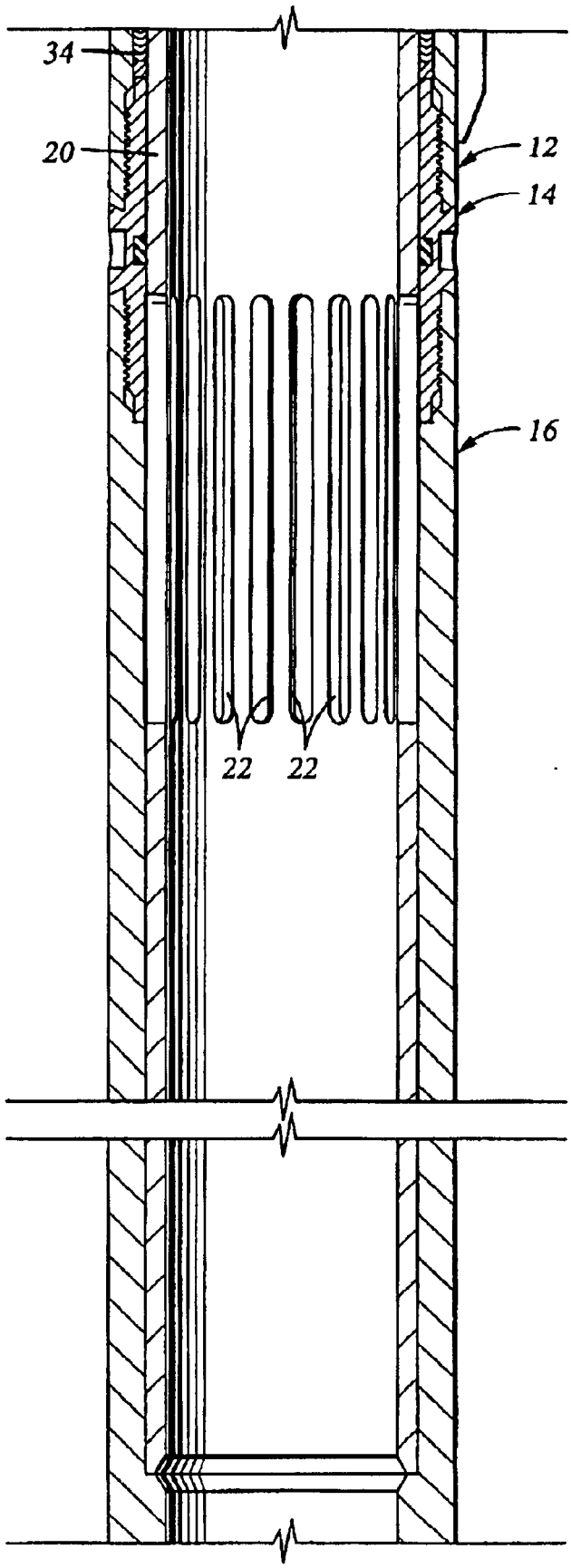

The lower end of the actuator housing 12 threadably assembles with a tubular sub 14 as shown by FIG. 1D. The bottom end of the sub 14 threadably assembles with a tubular bottom housing 16. The thread joint between the sub 14 and the bottom housing 16 compresses a chevron seal 34 against the outer cylindrical surface of the axially shifted sleeve 20.

The tubular wall of the actuator housing 12 is perforated by a number of elongated orifices 28 as seen from FIG. 1C. In open alignment with the actuator housing orifices 28 are the corresponding orifices 26 through a seal compression sleeve 24. The compression sleeve 24 engages the intermediate chevron seal 36 and is secured by an outer clamp 18. The chevron seal 36 wipes the regulator sleeve 20 surface.

Within the housing bore, a tubular sleeve 20 is disposed for a sliding seal fit with the chevron seals 30, 34 and 36. Through the lower end of the sleeve 20 tube wall, a number of elongated orifices 22 may be provided to cooperate with the housing orifices 26 and 28. The upper end of the regulator sleeve 20 carries a resilient snap ring 42 in a caging channel 44 shown by FIG. 1A. The outer corners of the snap ring 42 are chamfered to facilitate radial constriction of the snap ring perimeter by an axial thrust on the sleeve 20. The sleeve is designed for an operative stroke between the detent channels 40*a* and 40*g*, inclusive. The snap ring 42 seats into each detent channel 40 for a respective fluid flow relationship through the orifices 22, 26 and 28. When the snap ring 42 is seated in detent channel 40*a*, the valve is fully closed. When the snap ring 42 is seated in detent channel 40*g*, the valve is fully open. At each of the detent channel positions between 40*a* and 40*g*, a progressively increasing flow area is provided by increased alignment between the sleeve orifices 22 and the housing orifices 26, 28.

Along the outer surface of the sleeve 20 and aligned between the upper housing seal 30 and the intermediate seal 36 is a chevron seal 32 shown by FIG. 1C. The seal 32 is secured to the sleeve 20 and moves with it as a load piston. The seal 32 wipes the internal bore wall of a housing cylinder 13 and divides it into two variable volume pressure chambers 46 and 48. The upper pressure chamber 46 is served by a closing hydraulic conduit 50 from a surface source of hydraulic pressure supply as illustrated by FIG. 1B. The lower pressure chamber 48 is served by a hydraulic conduit 52 from the control actuator 60 as shown by FIG. 1C. The control actuator 60 is supplied with hydraulic fluid from the well surface through conduit 54 as shown by FIG. 1B for opening the valve.

Figure 2:
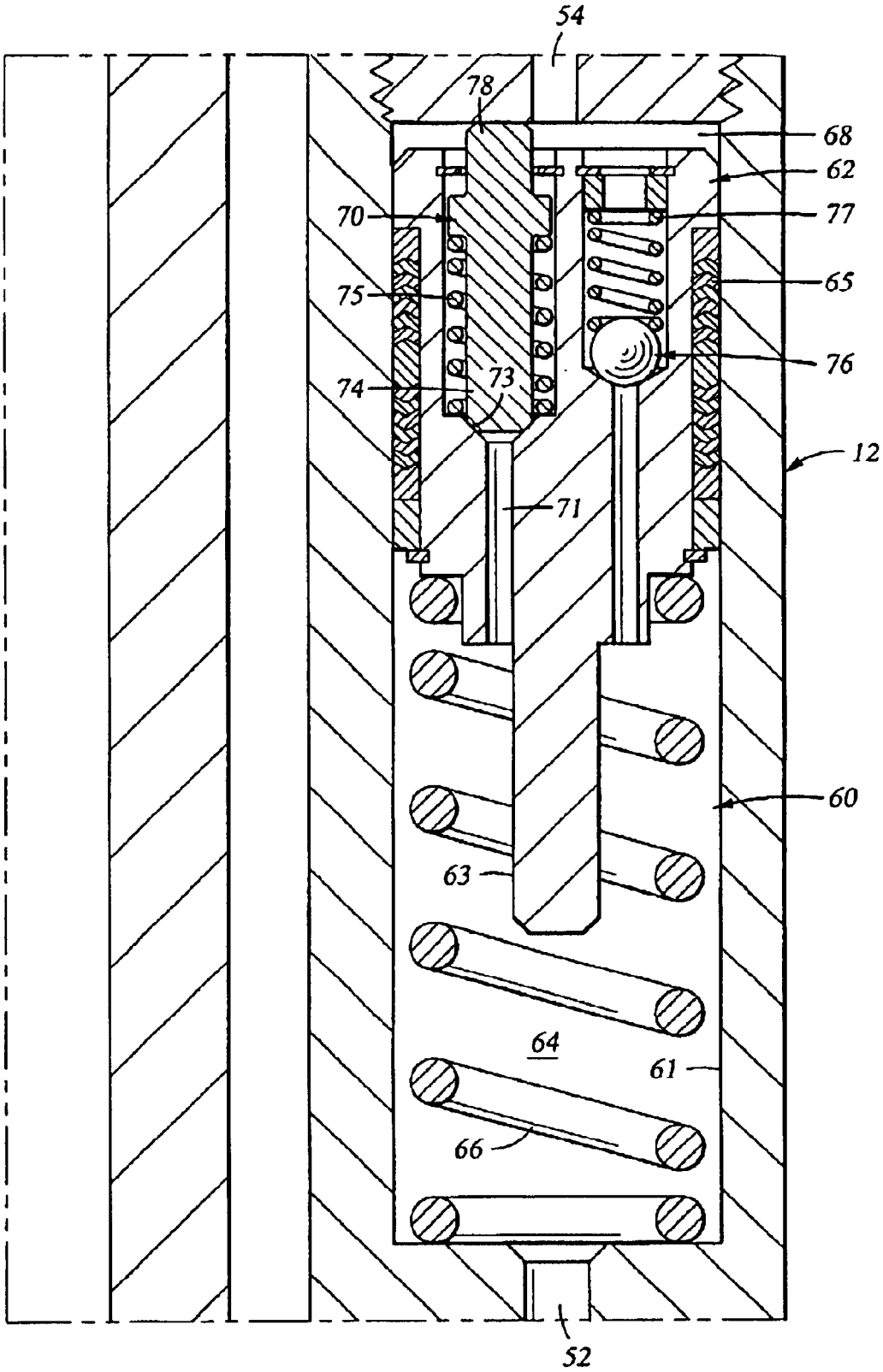
FIG. 2 is an axial section view of a first embodiment of the stepping valve actuator; and, FIG. 3 is an axial section view of a second embodiment of the stepping valve actuator.

One embodiment of the control actuator 60 is illustrated in detail by FIG. 2. An actuation cylinder 61 contains a stepping piston 62 for control of hydraulic fluid flow through the cylinder 61 along a direction of orientation from the supply conduit 54 to the sleeve control conduit 52. The stepping piston 62 has a sliding seal 65 with the wall of cylinder 61. A return spring 66 exerts a resilient bias on the stepping piston toward the fluid in-flow end of the cylinder 61. An orifice closure plug 63 projects axially from the out-flow end of the stepping piston to align with the entrance orifice of the sleeve control conduit 52. Distinctively, the volume 64 of cylinder 61 that is displaced by translation of the stepping piston 62 from the in-flow end of the cylinder 61 as illustrated by FIG. 2 to closure of the conduit 52 by the plug 63 substantially corresponds to the displaced volume of the lower sleeve chamber 48 for advancement of a single opening increment e.g. to move the sleeve snap ring 42 from the detent channel 40*b* to the detent channel 40*c*. A plurality of stepping piston 62 strokes may be required to move the sleeve 20 from an initial opening of the valve as illustrated by FIG. 1A and the axial distance between detent channels 40*a* and 40*b*.

The stepping piston 62 further comprises a fluid flow check valve 76 that is oriented to permit a reverse flow of fluid at a limited flow rate from the sleeve control conduit 52 toward the supply conduit 54 by lifting the valve closure off the valve conduit seat against the bias of closure spring 77.

Also within the body of the stepping piston 62 is a stepping valve 70 that comprises an orifice closure pintle 74 acting against the valve seat 73 around the flow orifice 71. A spring 75 exerts resilient bias on the pintle 74 to open the flow orifice 71. However, a salient end 78 of the pintle 74 projects above the in-flow end-plane of the pintle 74 to close the orifice 71 when the stepping piston 62 is pressed against the in-flow end of the cylinder 61 by the bias of return spring 66.

As illustrated by FIG. 1D, the regulator sleeve 20 is in the closed valve position. Opening of the valve to a minimum flow rate increment requires the sleeve 20 to be advanced upwardly to move the snap ring 42 from the detent position 40*a* illustrated to the adjacent detent position 40*b*. Such linear displacement of the sleeve position relative to the housing requires a finite volumetric increase in the lower pressure chamber 48. This finite volume of hydraulic fluid is displaced from the displacement chamber portion 64 of the actuation cylinder 61 by the stepping piston 62 as the piston is translated along the cylinder length.

Opening hydraulic pressure is directed from the surface along the opening hydraulic line 54 into the upper chamber 68 of the cylinder 61. The initial pressure differential across the opposite faces of the piston 62 closes both piston valves 70 and 76 and overcomes the spring bias 66 to drive the piston 62 toward the control conduit 52 thereby displacing the fluid volume 64 from the cylinder 61.

At the end of the piston 62 stroke, the plug 63 closes the entrance orifice of conduit 52 to terminate the fluid displacement from the actuation cylinder 61. Closure of the conduit 52 is signaled to the surface by an abrupt increase in the pressure of opening line conduit 54. The fluid displaced from actuation cylinder 61 is channeled into the lower sleeve chamber 48 to drive the sleeve snap ring 42 from detent channel 40*a* to 40*b*. The resilient bias of the snap ring 42 into the channel 40*b* secures the sleeve position at that location.

Upon receipt of the abrupt pressure increase, pressure in the opening conduit 54 is released at the surface and the return spring 66 is allowed to drive the stepping piston 62 toward the in-flow end of the cylinder 61. Without the high pressure differential across the stepping valve 70, the spring 75 displaces the pintle 74 from the valve seat 73 to permit a bypass flow of fluid from the conduit 54 through the orifice 71 into the displacement chamber 64 of cylinder 61 until the pintle salient 78 abuts the end wall of the cylinder.

The foregoing procedure is repeated for each increment of sleeve opening except that the pressure supplied to the opening conduit 54 that is required to overcome the progressively increased angle of each detent channel wall 40*c* through 40*g* increases correspondingly. Hence, by the pressure value required to advance the sleeve an increment, the identity of the opening increment may be known.

From any position of relative opening, the valve may be closed by a surface directed pressure charge along closing conduit 50 into the upper sleeve chamber 46. See FIGS. 1B and 1C. Correspondingly displaced fluid in the lower sleeve chamber 48 follows a reverse flow path along the actuator control conduit 52 into the cylinder 61 and past the stepping piston 62 through the check valve 76.

Figure 3:
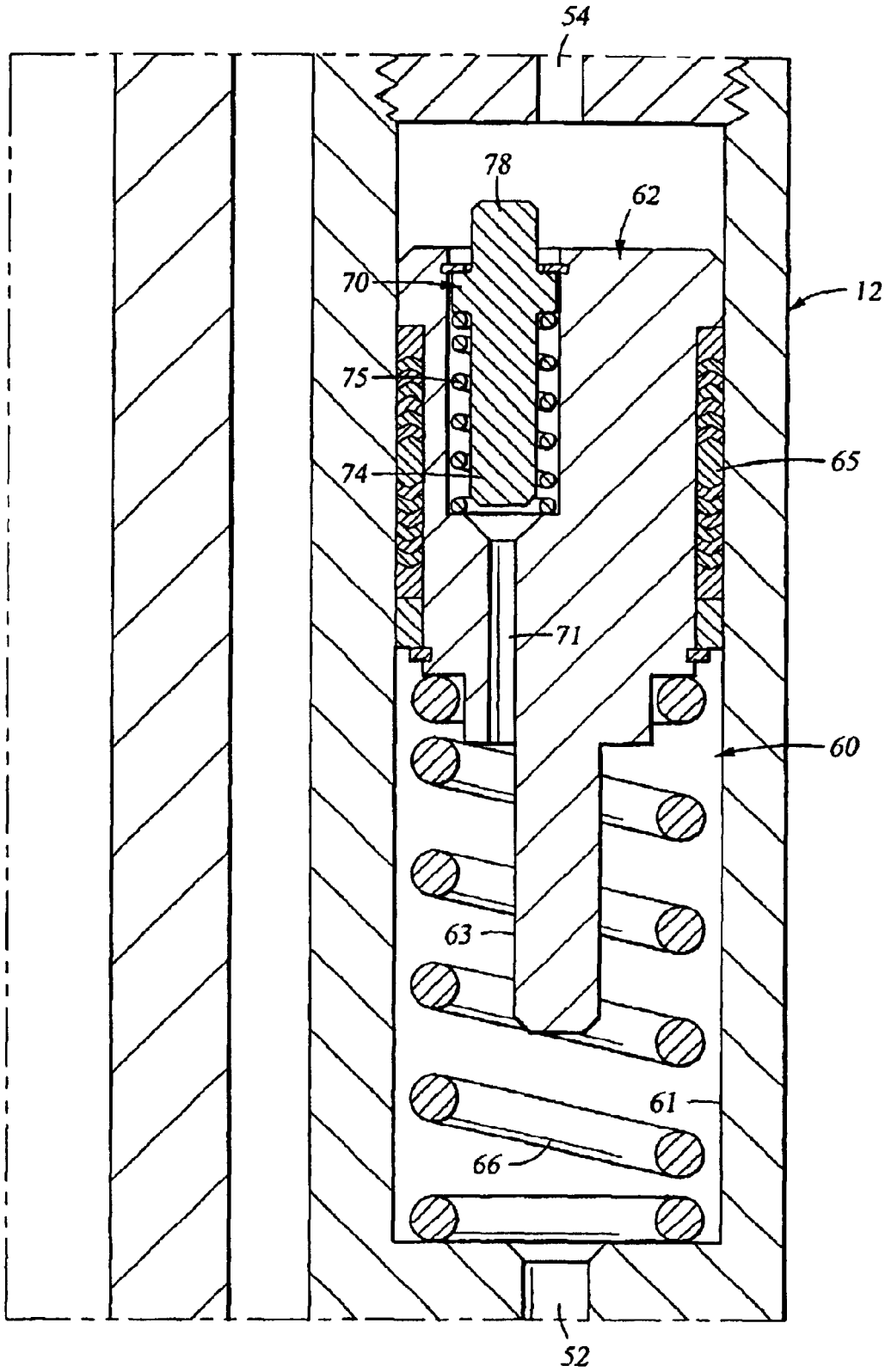

An alternative embodiment of the invention control actuator 60 is illustrated by FIG. 3. In this embodiment, the check valve 76 is omitted as separate apparatus. The bias force of stepping valve opening spring 75 is modified to keep the orifice 71 open against the closing bias of return spring 66 to permit a controlled bypass flow of fluid from the lower sleeve chamber when the valve is closed.

Use of sleeve retainer detent channels 40 having progressive side wall angles is one method of informational feedback for indicating the sleeve position. It should be understood by those of skill in the art that other devices may be used to accomplish the same end such as linear transducers.

Other applications for the actuator valve 60 described herein may include stepping control for under-reaming tools. It may also be used in a drill-stem testing tool to set an inflatable packer for pressure reversals without unsetting the tool. In another application, the actuator may be used to step set an inflatable packer to different inflation pressures. Similar to the present embodiments, the actuator may be used to step set a gas lift valve into different flow rate positions.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A well tubing valve comprising:

(a) a tubular housing (10) having at least one fluid flow aperture (28) through a housing perimeter wall;

(b) a fluid flow control element (20) cooperative with said flow aperture (28) for obstructing and permitting a predetermined fluid flow rate through said flow aperture;

(c) an actuator (60) proximate of said housing for incrementally translating said control element in a first direction to a selected flow rate position, the actuator comprising a piston within a cylinder;

(d) a first fluid supply conduit (54) serving said actuator and wherein fluid is delivered to said actuator through said first fluid supply conduit to bear upon a first end of the piston to displace a predetermined quantity of fluid from the cylinder; and, (e) a second fluid supply conduit (50) for translating said control element along a second direction.

2. A well tubing valve as described by claim 1 wherein said predetermined quantity of fluid is displaced from said cylinder (61) by an axial stroke of said piston (62) within said cylinder.

3. A well tubing valve as described by claim 2 wherein said predetermined quantity of fluid displaced from said cylinder (61) by each stroke of said piston (62) is channeled against said flow control element (20) for incremental translation of said element in said first direction.

4. A well tubing valve as described by claim 3 wherein said piston (62) is resiliently biased toward a first fluid supply end of said cylinder.

5. A well tubing valve as described by claim 4 wherein a first piston conduit (71) through said piston (62) includes a fluid flow obstruction element (78) that is resiliently biased to an open flow position whereby fluid may freely flow from said first end of said piston to a second end of said piston.

6. A well tubing valve as described by claim 5 wherein the bias on said piston (62) is greater than the bias on said flow obstruction element (78) whereby said piston bias closes said first piston conduit (71) against the bias of said obstruction element by abutting said obstruction element (78) against a first fluid supply end of said cylinder (61).

7. A well tubing valve as described by claim 4 wherein said piston (62) comprises a stepping valve for selectively permitting the flow of fluid from said first fluid supply conduit (54), through said piston for displacement against said flow control element (20).

8. An actuator for displacing a predetermined volume of fluid, said actuator comprising;

(a) a cylinder (61) having first (68) and second (64) ends, a first fluid conduit (54) for supplying fluid to said first cylinder end (68) and a second fluid conduit (52) for transferring displacement fluid from said second cylinder end (64);

(b) a piston (62) within said cylinder (61) disposed for axial translation within said cylinder, said piston having a first end proximate of said first cylinder end (68) and a second end proximate of said second cylinder end (64), said piston having an orifice plug (63) projecting from said second piston end for selectively obstructing entry of fluid into said second fluid conduit (52);

(c) a force element (66) bearing upon said piston (62) second end to bias said piston toward said first cylinder end;

(d) a first piston conduit (71) for transfer of fluid through said piston (62) between said first and second ends; and, (e) a first valve element (78) for controlling fluid flow through said first piston conduit (71), said valve element (78) being resiliently biased to a position that is open to flow between opposite ends of said piston and closed by abutment against said first cylinder end.

9. An actuator as described by claim 8 having a second piston conduit for transfer of fluid through said piston, a second valve element (76) in said second piston conduit that is open to fluid flow from said second end to said first end and closed to flow from said first end to said second end.

10. An actuator as described by claim 8 wherein said first valve element (78) is held at a closed conduit position by a fluid pressure differential between said first and second piston ends.

11. A system for controlling the flow of well fluid between a well annulus and an internal flowbore of a tubing string, said system comprising:

(a) a tubular housing (12) in said tubing string having a fluid flow aperture (28) through a tubular wall thereof around said flowbore;

(b) a substantially coaxial tubular sleeve (20) adjacent said housing for selectively obstructing the fluid flow area of said flow aperture (28);

(c) a first actuator (50) for selectively displacing said sleeve in a first direction; and, (d) a second actuator (54) for incrementally displacing said sleeve (20) in a second direction wherein a fluid flow area through said aperture is changed in corresponding increments, and a force required to displace said sleeve from one flow rate increment to another increases incrementally.

12. A system as described by claim 11 wherein said sleeve is restrained at each position increment by a resilient detent mechanism (42).

13. A fluid actuator for displacing a predetermined volume of fluid comprising:

a piston (62) disposed within a cylinder (61) for displacement of a predetermined fluid volume by translation from one end of said cylinder toward an opposite end;

a force bias (66) of said piston toward said one cylinder end;

a fluid supply (54) to said one cylinder end; and, a pressure differentially closed piston by-pass conduit (71) whereby said conduit is closed by a fluid pressure in said cylinder one end that is sufficient to displace said piston against said force bias.

14. A fluid actuator as described by claim 13 wherein said by-pass conduit (71) is opened by translation of said piston (62) toward said one end.

15. A fluid actuator as described by claim 14 wherein said by-pass conduit (71) is closed by arrival of said piston (62) at a translational limit respective to said one cylinder end.

16. A fluid actuator as described by claim 13 wherein said by-pass conduit (71) is disposed through said piston (62).

17. A fluid actuator as described by claim 13 having a second pressure differentially closed piston by-pass conduit (76) for permitting a fluid flow from said opposite cylinder end toward said one end.

18. A fluid actuator as described by claim 13 wherein said second by-pass conduit (76) is disposed through said piston (62).

* * * * *